US006479204B1

(12) United States Patent
Uchinokura et al.

(10) Patent No.: US 6,479,204 B1
(45) Date of Patent: Nov. 12, 2002

(54) MAGNETIC TONER WITH NEGATIVE POLARITY FOR DEVELOPING LATENT ELECTROSTATIC IMAGES, AND IMAGE FORMING APPARATUS USING THE SAME

(75) Inventors: Osamu Uchinokura, Shizuoka (JP); Tomio Kondou, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 153 days.

(21) Appl. No.: 09/586,337

(22) Filed: Jun. 2, 2000

(30) Foreign Application Priority Data

Jun. 4, 1999 (JP) ..... 11-157878

(51) Int. Cl.[7] ..... G03G 9/083
(52) U.S. Cl. ..... 430/108.23; 399/277
(58) Field of Search ..... 430/108.23, 108.1; 399/277

(56) References Cited

U.S. PATENT DOCUMENTS 5,744,276 A * 4/1998 Ohno et al. ..... 430/108.32

5,882,832 A * 3/1999 Tosaka et al. ..... 430/108.32

* cited by examiner

*Primary Examiner*—John Goodrow
(74) *Attorney, Agent, or Firm*—Cooper & Dunham LLP

(57) ABSTRACT

A magnetic toner with a negative polarity for developing latent electrostatic images is made of toner particles, each toner particle containing a binder resin, a magnetic powder, and a charge control agent, the surface of the magnetic toner satisfying the relationship of $2\times10^{-7}\leqq C/Sw\leqq10\times10^{-7}$, provided $C\leqq8\times10^{-3}$, wherein C is an amount (g/g) of the charge control agent dissolved in a solvent comprising water and methanol, and Sw is a specific surface area ($cm^2/cm^3$) of the toner particles determined from a weight-average particle diameter of the toner particles. An image forming apparatus has an electrostatic image bearing member, and a unit for developing the electrostatic image with the above magnetic toner, the unit having a developer holding member provided with a magnet, and a developer container. A method for measuring the amount of a charge control agent extracted from the surface of magnetic toner particles employs an aqueous alcohol solvent of water and an alcohol.

4 Claims, 1 Drawing Sheet

FIGURE
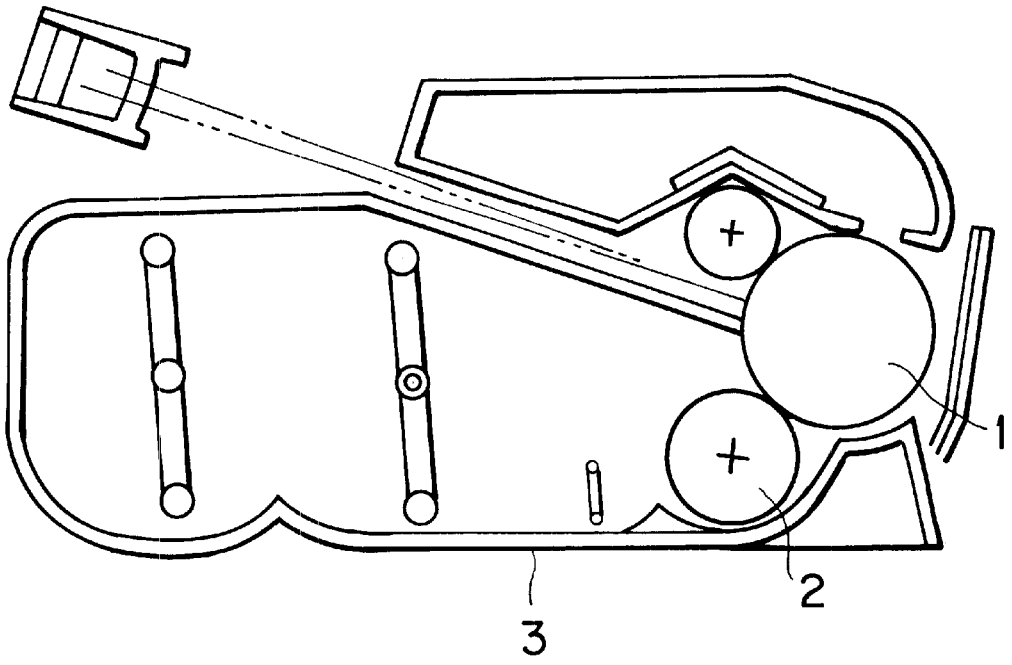

MAGNETIC TONER WITH NEGATIVE POLARITY FOR DEVELOPING LATENT ELECTROSTATIC IMAGES, AND IMAGE FORMING APPARATUS USING THE SAME

BACKGROUND OF THE INVENTION

1. Field of the Invention

The present invention relates to a magnetic toner with a negative polarity for developing latent electrostatic images in the fields of electrophotography and electrostatic printing, and an image forming apparatus using the above-mentioned magnetic toner. In addition, the present invention also relates to a method for measuring the amount of a charge control agent extracted from the surface of magnetic toner particles by allowing a solvent to selectively dissolve the charge control agent therein.

2. Discussion of Background

To develop latent electrostatic images formed on the surface of a latent electrostatic image bearing member such as an electrophotographic photoconductor or electrostatic printing member, a wet type development method and a dry type development method are currently available. The wet type development employs a liquid developer, while the dry type development employs a one-component developer comprising a toner which comprises a binder resin and a coloring agent dispersed therein, or a two-component developer comprising the above-mentioned toner and a carrier. Although these development methods have their own advantages and disadvantages, the dry type development is particularly widely used.

Among the above-mentioned development methods, the one-component development method is advantageous because the system for controlling the concentration of toner is not necessary, and accordingly, stirring means in the development unit can be simplified. This can reduce the size of the image forming apparatus, so that the one-component development method has been particularly adapted in the field of printer.

The one-component development method is divided into a magnetic development system and a non-magnetic development system. The former system adapts the combination of a magnetic toner and a magnetic development sleeve; the latter adapts the combination of a non-magnetic toner and a non-magnetic development sleeve. More advantages can be found in the magnetic one-component development system than in the non-magnetic system.

Whether the toner is a magnetic toner or non-magnetic toner, a desired charge quantity of toner cannot be obtained merely by dispersing a coloring agent such as a dye or pigment in a binder resin. A charge control agent is usually added in a proper amount to the formulation of toner. However, when the charge control agent is contained in the toner, the problem of a toner film being deposited on the development sleeve tends to easily occur. This problem is hereinafter referred to as toner filming. Although the initial image quality and initial development properties are satisfactory, the performance of the charge control agent is lowered for an extended period of time, if the toner filming occurs, thereby impairing the image quality of the obtained toner images and the development properties. The decrease of image quality and development properties is considered to result from the performance of the charge control agent itself, and the dispersion properties of the charge control agent in the toner particles. In particular, the dispersed condition of the charge control agent in the surface portions of toner particles, which come in direct contact with the development sleeve, largely affects the toner filming problem. It is generally supposed that the occurrence of toner filming is accelerated in the development of an image with a small area because such a toner image stays on the development sleeve for a long period of time.

In the two-component development method, special attention has been paid to the dispersed condition of a charge control agent in the surface portion of toner particles.

For example, Japanese Laid-Open Patent Applications 8-12309, 61-36767, and 5-150554 report that the charging characteristics of toner can be stabilized, and the problems of spent toner, toner scattering, and fogging can be effectively reduced by measuring and controlling the concentration of charge control agent in the surface portions of the toner particles by absorptiometric method or potential difference method.

In the above-mentioned conventional methods of measuring the concentration of charge control agent, the toner particles are placed in a solvent which consists of such an alcohol that cannot dissolve the employed binder resin therein, but can dissolve the charge control agent therein. These methods are evaluated as effective for the non-magnetic toner. However, as to the case of the magnetic toner, there is no description about the specific effect of such measuring methods in the above-mentioned applications.

The inventors of the present invention have tried to measure the concentration of a charge control agent existing in the surface portion of toner particles for use in a magnetic toner in accordance with the above-mentioned conventional methods. As a result, such conventional methods proved to be impractical when used for the magnetic toner. This is because all the charge control agent, not only existing in a surface portion, but also in an inner part of the magnetic toner particles, was dissolved in the solvent with the elapse of time. It became clear that the concentration of the charge control agent in the surface portion of the magnetic toner particles cannot be precisely measured.

In general, a polymeric material, such as polystyrene, serving as a binder resin for use in a toner used for developing latent electrostatic images is known to be insoluble in an alcohol, but apt to swell therein. On the other hand, a magnetic powder for use in the magnetic toner is insoluble in an alcohol, and does not swell therein. Therefore, when such a magnetic toner is placed in an alcohol solvent, gaps are generated between the polymeric material serving as a binder resin and the magnetic powder, and the alcohol penetrates into the inside of the toner particles through the above-mentioned gaps. The result is that even the charge control agent existing in the inner part of the toner particles is dissolved in the alcohol.

SUMMARY OF THE INVENTION

It is therefore a first object of the present invention to provide a magnetic toner for developing latent electrostatic images, capable of preventing the toner filming problem and producing high quality toner images for a long period of time.

A second object of the present invention is to provide an image forming apparatus using the above-mentioned magnetic toner.

A third object of the present invention is to provide a method for measuring the amount of a charge control agent extracted from the surface of toner particles of a magnetic toner comprising the charge control agent.

The above-mentioned first object of the present invention can be achieved by a magnetic toner with a negative polarity for developing latent electrostatic images, comprising toner particles, each toner particle comprising a binder resin, a magnetic powder, and a charge control agent, the surface of the magnetic toner satisfying the relationship of $2\times10^{-7}\leqq C/Sw\leqq10\times10^{-7}$, provided $C\leqq8\times10^{-3}$, wherein C is an amount (g/g) of the charge control agent dissolved in a solvent comprising water and methanol per unit amount (g) of the toner particles, and Sw is a specific surface area ($cm^2/cm^3$) determined from a weight-average particle diameter of the toner particles.

The second object of the present invention can be achieved by an image forming apparatus comprising a member for bearing an electrostatic image thereon, and developing means for developing the electrostatic image with a developer, that is, the above-mentioned magnetic toner with a negative polarity, comprising a developer holding member provided with a magnet, and a developer container for storing the developer therein.

The third object of the present invention can be achieved by a method for measuring the amount of a charge control agent extracted from the surface of toner particles of a magnetic toner comprising the charge control agent, using an aqueous solvent comprising water and an alcohol, comprising the steps of wetting the magnetic toner with water, adding an alcohol to the magnetic toner wetted with water, stirring the mixture of the magnetic toner wetted with water and the alcohol added, thereby extracting the charge control agent from the surface of the toner particles with a mixture of the alcohol and water, which constitutes the aqueous alcohol solvent, the aqueous alcohol solvent comprising 15 to 30 vol. % of water, and 70 to 85 vol. % of the alcohol with the total volume percentage of the aqueous alcohol solvent being 100 vol. %, and separating the toner particles from the aqueous alcohol solvent, using a magnet, to obtain an extract liquid in which the charge control agent is dissolved.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a schematic cross-sectional view which shows an image forming apparatus of the present invention for implementing a one-component development method using a magnetic toner according to the present invention.

DESCRIPTION OF THE PREFERRED EMBODIMENTS

A magnetic toner with a negative polarity according to the present invention comprises toner particles, each toner particle comprising a binder resin, a magnetic powder, and a charge control agent. The charge control agent is dispersed in a surface portion of the toner particle, and the surface of the magnetic toner satisfies the relationship of:

$2\times10^{-7} \leqq C/Sw \leqq 10\times10^{-7}$, provided $C \leqq 8\times10^{-3}$, wherein C is an amount (g/g) of the charge control agent dissolved in a solvent comprising water and methanol per unit amount (g) of the toner particles, and Sw is a specific surface area ($cm^2/cm^3$) of the toner particles determined from the weight-average particle diameter of the toner particles.

The above-mentioned method for measuring the amount (C) of a charge control agent extracted from the surface of toner particles of the magnetic toner will now be described in detail.

This method employs an aqueous alcohol solvent comprising water and an alcohol. The aqueous alcohol solvent comprises 15 to 30 vol. % of water, and 70 to 85 vol. % of the alcohol, with the total volume percentage of the aqueous alcohol solvent being 100 vol. %.

According to this method, the magnetic toner is first wetted with water, and an alcohol is added to the magnetic toner wetted with water, followed by stirring, for example, using a ball mill. The alcohol solvent selectively dissolve the charge control agent present in the surface portion of the toner particles by the process of extraction. Then, the magnetic toner particles are separated from the aqueous alcohol solvent, using a magnet. The resultant aqueous alcohol solvent may be subjected to filtration, thereby obtaining an extract liquid in which the charge control agent is dissolved. Thereafter, the amount of the charge control agent contained in the extract liquid may be measured by the absorptiometric method. In this case, not only the absorptiometric method, but also other conventional methods are available.

Through the intensive studies, the inventors of the present invention have found that the obtained amount (C) of charge control agent does not change in a relatively short period of time when the charge control agent is extracted from the toner particles into the solvent in the above-mentioned manner. The reason for this is that the solvent comprises water which has a strong polar group, and does not dissolve constituents of a toner. The toner has substantially no compatibility with water. Since the toner is wetted with water at the first step, the compatibility of the toner with an alcohol is lowered and swelling of the polymeric material in alcohol becomes slow even though the alcohol is added to the toner at the second step. Although the alcohol is a good solvent with respect to the charge control agent for use in the toner, the alcohol solvent selectively dissolves only the charge control agent present in the surface portion of the toner particles in a short period of time.

The inventors of the present invention have also discovered that there is a correlation between the thus obtained amount (C) of charge control agent, which is obtained by the process of extraction in a short period of time, and the occurrence of toner filming problem.

The amount (C) of charge control agent obtained by the above-mentioned method varies depending upon the particle size of toner particles. This is because the specific surface area of the toner particles is changed by a variation of the particle size thereof. The ratio of the amount (C) of charge control agent to the specific surface area (Sw) of toner particles, that is, C/Sw, is almost constant. Namely, regardless of the particle size of toner particles, the larger the ratio (C/Sw), the higher the possibility of the toner filming problem. On the other hand, the smaller the ratio (C/Sw), the poorer the charging characteristics of toner. More specifically, according to the present invention, the ratio (C/Sw) is controlled to $10\times10^{-7}$ or less, preferably $9\times10^{-7}$ or less. When the ratio (C/Sw) exceeds $10\times10^{-7}$, the charge control agent present in the surface portion of the toner particles is excessive, so that the toner filming phenomenon easily occurs. On the other hand, when the ratio (C/Sw) is less than $2\times10^{-7}$, charging quantity of toner required for stable charging cannot be obtained.

According to the present invention, methanol is preferably used as the alcohol in the method for measuring the amount of charge control agent extracted from the surface of the toner particles using the aqueous alcohol solvent. In addition to methanol, ethanol and other alcohols are available so long as the charge control agent is dissolved therein. In other words, the kind of alcohol and the stirring conditions may be appropriately determined so that the amount of charge control agent selectively dissolved in the employed aqueous alcohol solvent is substantially saturated in a short period of time.

The aforementioned ratio (C/Sw) is defined using methanol as the alcohol for use in the aqueous alcohol solvent in the present invention.

Although the particle size distribution of the magnetic toner particles can be obtained by various methods, the present invention adapts Coulter counter method with a commercially available "Coulter Counter model TA-II" (Trademark) or "Counter Multisizer II" (Trademark), made by Coulter Electronics Limited. Using an aperture tube with a diameter of 100 μm, the number of toner particles and the volume are measured, and the distribution of particles with a diameter of 2 to 40 μm is calculated in terms of the number and the volume of particles. Thus, a weight-average particle diameter is obtained from the particle volume distribution.

Further, using the thus obtained particle size distribution, the specific surface area can be obtained from the entire surface area of toner particles per unit volume.

It is preferable that the charge control agent for use in the magnetic toner of the present invention comprise at least one metal-containing azo compound selected from the group consisting of chromium-containing azo compound of formula (I) and iron-containing azo compounds of formulas (II) and (III):

(I)

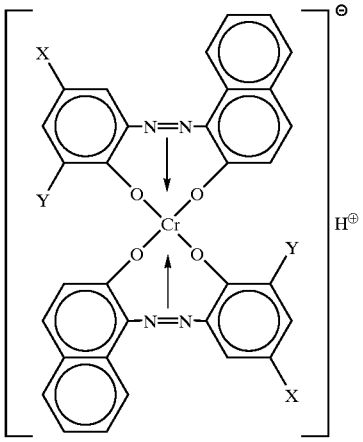

wherein X is nitro group, sulfonamide group, or a halogen atom; and Y is a hydrogen atom, a halogen atom, or nitro group, provided that X and Y are not nitro group at the same time;

(II)

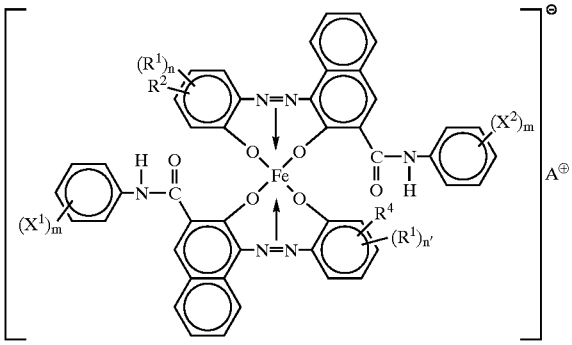

wherein $X^1$ and $X^2$, which may be the same or different, each are a hydrogen atom, a lower alkyl group, a lower alkoxyl group, nitro group, or a halogen atom; m and m' each are an integer of 1 to 3; $R^1$ and $R^3$, which may be the same or different, each are a hydrogen atom, an alkyl group having 1 to 19 carbon atoms, an alkenyl group, sulfonamide group, mesyl group, sulfonic group, carboxylate group, hydroxyl group, an alkoxyl group having 1 to 19 carbon atoms, acetylamino group, benzoylamino group, or a halogen atom; n and n' each are an integer of 1 to 3; $R^2$ and $R^4$ each are a hydrogen atom or nitro group; and $A^+$ is a hydrogen cation, sodium cation, potassium cation, or ammonium cation; and (III)

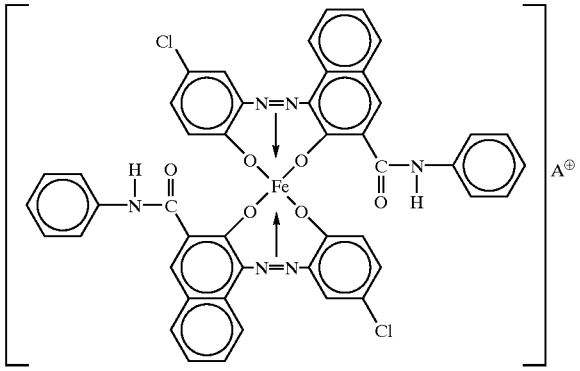

wherein $A^+$ is a mixture of $NH^+$, $Na^+$ and $H^+$, with a molar ratio of $NH^+$ to $Na^+$ to $H^+$ being (0.80 to 0.98):(0.01 to 0.19):(0.01 to 0.19) provided that the molar ratios of $NH^-$, $Na^+$ and $H^+$ is 1 in total.

One of the preferable examples of the charge control agents for use in the present invention is a chromium-containing azo compound represented by the following formula (IV):

(IV)

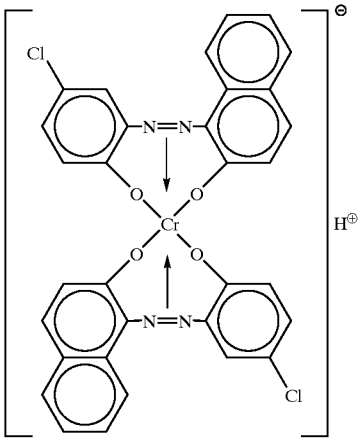

The amount of the charge control agent can be appropriately determined depending upon the kind of binder resin, the types of additives to be employed, and the amounts of those constituents, and the dispersion method to be adapted. It is preferable that the amount of the charge control agent be in the range of about 0.1 to 3.0 parts by weight, more preferably in the range of 0.1 to 2.0 parts by weight, with respect to 100 parts by weight of the toner. When the amount ratio of the charge control agent is within the above-mentioned range, sufficient charging characteristics can be imparted to the toner, and the amount of the charge control agent present in the surface portion of toner particles can be controlled so as to satisfy the above-mentioned relationship.

In particular, the iron-containing azo compound of formula (III) is effective for prevention of the toner filming phenomenon.

Specific examples of the binder resin for use in the magnetic toner of the present invention are as follows: homopolymers of styrene or substituted styrenes, such as polystyrene, poly(p-chlorostyrene), and poly(vinyltoluene); styrene copolymers such as styrene-p-chlorostyrene copolymer, styrene-propylene copolymer, styrene-vinyltoluene copolymer, styrene-vinylnaphthalene copolymer, styrene-acrylate copolymer, styrene-methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer; and other resins such as acrylic resin, methacrylic resin, poly(vinyl chloride), poly(vinyl acetate), polyethylene, polypropylene, polyester resin, poly(vinyl butyral), poly(acrylic acid) resin, rosin, modified rosin, terpene resin, phenolic resin, natural-resin-modified phonolic resin, natural-resin-modified maleic resin, polyurethane, polyamide resin, furan resin, epoxy resin, coumarone-indene resin, silicone resin, aliphatic or alicyclic hydrocarbon resin, and aromatic petroleum resin. These resins can be employed alone or in combination.

Of the above-mentioned resins, styrene copolymers and polyester resin are preferable in light of the developing properties and image fixing performance.

Examples of comonomers for constituting the styrene copolymers are as follows: double-bond containing monocarboxylic acids, which may have a substituent, such as acrylic acid, methyl acrylate, ethyl acrylate, butyl acrylate, dodecyl acrylate, octyl acrylate, 2-ethyhexyl acrylate, phenyl acrylate, methacrylic acid, methyl methacrylate, ethyl methacrylate, butyl methacrylate, octyl methacrylate, acrylonitrile, methacrylonitrile, and acrylamide; double-bond containing dicarboxylic acids, which may have a substituent, such as maleic acid, butyl maleate, methyl maleate, and dimethyl maleate; vinyl eaters such as vinyl chloride, vinyl acetate, and vinyl benzoate; olefins such as ethylene, propylene, and butylene; vinyl ketones such as vinyl methyl ketone, and vinyl hexyl ketone; and vinyl ethers such as vinyl methyl ether, vinyl ethyl ether, and vinyl isobutyl ether. These vinyl monomers can be employed alone or in combination.

The polyester resin preferably serving as a binder resin for use in the toner can be synthesized by the conventional method using an alcohol component and an acid component.

Examples of the alcohol component for synthesizing the polyester include diols such as polyethylene glycol, diethylene glycol, triethylene glycol, 1,2-propylene glycol, 1,3-propylene glycol, 1,4-propylene glycol, neopentyl glycol, and 1,4-butene diol; etherified bisphenols and dihydric alcohol monomers prepared by substituting the above-mentioned bisphenols with a saturated or unsaturated hydrocarbon group having 3 to 22 carbon atoms, and other dihydric alcohol monomers, such as 1,4-bis(hydroxymethyl) cyclohexane, bisphenol A, hydrogenated bisphenol A, polyoxyethylene bisphenol A, and polyoxypropylene bisphenol A; and polyhydric alcohol monomers having three or more hydroxyl groups, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxymethylbenzene.

Examples of the acid component for synthesizing the polyester include monocarboxylic acids such as palmitic acid, stearic acid, and oleic acid; dicarboxylic acids, which may have as a substituent a saturated or unsaturated hydrocarbon group having 3 to 22 carbon atoms, such as maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipinic acid, sebacic acid, and malonic acid, anhydrides of the above dicarboxylic acids, and other dicarboxylic acids; and carboxylic acids with three or more carboxyl groups, such as 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, and tetra (methylenecarboxyl)methane, and anhydrides of the above carboxylic acids with three or more carboxyl groups.

The toner of the present invention comprises a magnetic powder. As the magnetic powder, there is preferably employed a magnetic iron oxide powder, in particular, with an average particle diameter of 0.1 to 0.3 $\mu$m. When necessary, the magnetic iron oxide powder may be used in combination with the conventional magnetic powder. In this case, it is preferable that the average particle diameter of the obtained magnetic powder be in the range of 0.1 to 0.5 $\mu$m.

It is preferable that the amount of the magnetic powder be in the range of 10 to 50 wt. % of the total weight of the toner. When the magnetic powder is contained in an amount of 10 wt. % or more, the decrease of transporting properties of the obtained magnetic toner can be prevented, so that the toner can be smoothly supplied so as not to decrease the image density. On the other hand, when the magnetic powder is contained in an amount of 50 wt. % or less, the decrease in image density can be avoided, and a thin line image can be prevented from becoming unclear.

The magnetic toner according to the present invention may further comprise a releasing agent.

Specific examples of the releasing agent for use in the present invention are low-molecular-weight polyethylene, low-molecular-weight polypropylene, paraffin wax, carnauba wax, montan wax, rice wax, and sazol wax. These waxes can be employed alone or in combination.

It is preferable that the releasing agent be contained in the toner in an amount of 0.5 to 5 parts by weight to 100 parts by weight of the toner.

The magnetic toner according to the present invention may further comprise other additives when necessary. Examples of the additives for use in the magnetic toner are a fluidity imparting agent such as hydrophobic silica, titanium oxide, or aluminum oxide; a caking preventing agent; a lubricant such as ethylene tetrafluoride resin or zinc stearate; an electro-conductivity providing agent such as carbon black or tin oxide; an abrasive such as cerium oxide or silicon carbide; and an image fixing promoting agent such as low-molecular-weight polyolefin. Those additives may be used in combination. It is preferable that the additives be contained in the toner in an amount of 0.1 to 3 parts by weight in total, with respect to 100 parts by weight of the toner.

To produce the magnetic toner of the present invention, for instance, the previously mentioned constituents, such as a binder resin, magnetic powder, and charge control agent, may be mixed in a mixer such as a Henschel mixer, and thereafter kneaded in a kneader, such as a continuous kneader or a roll kneader, under application of heat thereto. The kneaded mixture is cooled and made solid, and the solid material is pulverized and classified to obtain a magnetic toner with a desired average particle diameter.

Dispersion of the charge control agent in the surface portion of the obtained toner particles is of great importance. This is because it is required to control of the amount of the charge control agent present in the surface portion of the toner particles according to the present invention. In the above-mentioned production method, the dispersion properties of the charge control agent in the surface portion of the obtained toner particles can be improved by sufficiently performing preliminary mixing, and adjusting the temperature in the kneading step. Further, it is important that the cooling conditions after the kneading step be severely controlled to inhibit re-aggregation of charge control agent. Thus, the conditions of the unit in each step for producing the toner may be set so that the amount (C) of charge control agent obtained by the method of the present invention is $8\times10^{-3}$ g/g or less, and the ratio of the amount (C) to the specific surface area (Sw) is within the range from $2\times10^{-7}$ to $10\times10^{-7}$.

The method for producing the magnetic toner of the present invention is not limited to the above-mentioned method. There can be employed spray drying method, polymerization method, and microencapsulation method.

The magnetic toner thus produced may be mixed with desired external additives, when necessary, using a mixer such as a Henschel mixer.

It is preferable that the weight-average particle diameter of toner particles of the magnetic toner according to the present invention be in the range of 4 to 11 μm, more preferably 5 to 9 μm.

An image forming apparatus according to the present invention comprises a member for bearing an electrostatic image thereon, and developing means for developing the electrostatic image with a developer, comprising a developer holding member provided with a magnet, and a developer container for storing the developer therein, the employed developer being the above-mentioned magnetic toner with a negative polarity.

Other features of this invention will become apparent in the course of the following description of exemplary embodiments, which are given for illustration of the invention and are not intended to be limiting thereof.

Example 1

| | Parts by Weight |
|---|---|
| Polyester resin (glass transition temperature: 66° C.) | 100 |
| Chromium-containing azo compound (charge control agent of formula (IV)) | 1 |
| Magnetic iron oxide | 80 |
| Carnauba wax | 5 |

A mixture of the above-mentioned components was thoroughly stirred, and kneaded in a continuous kneader at 130 to 140° C. to prepare a kneaded mixture. Immediately after completion of kneading, the kneaded mixture was cooled to 50° C. at a cooling rate of 20° C./sec. The mixture was then pulverized and classified to obtain a black powder with a weight-average particle diameter of 9 μm.

100 parts by weight of the black powder were mixed with one part by weight of hydrophobic silica, whereby a magnetic toner No. 1 according to the present invention was prepared.

Example 2

The procedure for preparation of the magnetic toner No. 1 in Example 1 was repeated except that the formulation for the magnetic toner No. 1 employed in Example 1 was changed as shown below.

| | Parts by Weight |
|---|---|
| Styrene-butyl methacrylate copolymer (glass transition temperature: 62° C.) | 100 |
| Iron-containing azo compound (charge control agent of formula (III)) | 2 |

-continued

| | Parts by Weight |
|---|---|
| Magnetic iron oxide | 80 |
| Low molecular weight polypropylene | 5 |

Thus, a magnetic toner No. 2 according to the present invention was prepared.

Example 3

The procedure for preparation of the magnetic toner No. 2 in Example 2 was repeated except that the weight-average particle diameter of the black powder obtained by classification was changed from 9 to 7 μm.

Thus, a magnetic toner No. 3 according to the present invention was prepared.

Example 4

The procedure for preparation of the magnetic toner No. 1 in Example 1 was repeated except that the formulation for the magnetic toner No. 1 employed in Example 1 was changed as shown below, and that the weight-average particle diameter of the black powder obtained by classification was changed from 9 to 6 μm.

| | Parts by Weight |
|---|---|
| Styrene-butyl methacrylate copolymer (glass transition temperature: 62° C.) | 100 |
| Chromium-containing azo compound (charge control agent of formula (IV)) | 3 |
| Magnetic iron oxide | 80 |
| Carnauba wax | 5 |

Thus, a magnetic toner No. 4 according to the present invention was prepared.

Example 5

The procedure for preparation of the magnetic toner No. 1 in Example 1 was repeated except that the formulation for the magnetic toner No. 1 employed in Example 1 was changed as shown below.

| | Parts by Weight |
|---|---|
| Polyester resin (glass transition temperature: 66° C.) | 100 |
| Iron-containing azo compound (charge control agent of formula (III)) | 3 |
| Magnetic iron oxide | 80 |
| Low molecular weight polypropylene | 5 |

Thus, a magnetic toner No. 5 according to the present invention was prepared.

Comparative Example 1

The procedure for preparation of the magnetic toner No. 1 in Example 1 was repeated except that the formulation for the magnetic toner No. 1 employed in Example 1 was changed as shown below, and that the weight-average particle diameter of the black powder obtained by classification was changed from 9 to 6 μm.

| | Parts by Weight |
|---|---|
| Styrene-butyl methacrylate copolymer (glass transition temperature: 62° C.) | 100 |
| Chromium-containing azo compound (charge control agent of formula (IV)) | 1 |
| Magnetic iron oxide | 80 |
| Carnauba wax | 5 |

Thus, a comparative magnetic toner No. 1 was prepared.

Comparative Example 2

100 parts by weight of a polyester resin with a glass transition temperature of 70° C., 80 parts by weight of a magnetic from oxide powder, and 5 parts by weight of low-molecular-weight polypropylene were mixed to prepare a mixture. With the addition of 3 parts by weight of an iron-containing azo compound represented by the above-mentioned formula (III) to the mixture, the resultant mixture was thoroughly mixed. The time used for the mixing step in total was the same as that for the mixing step in Example 1.

The thus obtained mixture was kneaded in a continuous kneader at 130 to 140° C. to prepare a kneaded mixture. Immediately after completion of kneading, the kneaded mixture was cooled to 50° C. at a cooling rate of 20° C./sec. The mixture was then pulverized and classified to obtain a black powder with a weight-average particle diameter of 9 μm.

100 parts by weight of the black powder were mixed with one part by weight of hydrophobic silica, whereby a comparative magnetic toner No. 2 was prepared.

Comparative Example 3

The procedure for preparation of the magnetic toner No. 1 in Example 1 was repeated except that the formulation for the magnetic toner No. 1 employed in Example 1 was changed as shown below.

| | Parts by Weight |
|---|---|
| Styrene-butyl methacrylate copolymer (glass transition temperature: 62° C.) | 100 |
| Chromium-containing azo compound (charge control agent of formula (IV)) | 3 |
| Magnetic iron oxide | 80 |
| Carnauba wax | 5 |

Thus, a comparative magnetic toner No. 3 was prepared.

Comparative Example 4

| | Parts by Weight |
|---|---|
| Polyester resin (glass transition temperature: 70° C.) | 100 |
| Iron-containing azo compound (charge control agent of formula (III)) | 3 |
| Magnetic iron oxide | 80 |
| Low-molecular-weight polypropylene | 5 |

A mixture of the above-mentioned components was thoroughly stirred, and kneaded in a continuous kneader at 130 to 140° C. to prepare a kneaded mixture. Immediately after completion of kneading, the kneaded mixture was cooled to 50° C. at a cooling rate of 4° C./sec. The mixture was then pulverized and classified to obtain a black powder with a weight-average particle diameter of 9 μm.

100 parts by weight of the black powder were mixed with one part by weight of hydrophobic silica, whereby a comparative magnetic toner No. 4 was prepared.

[Measurement of the amount of charge control agent]

The amount of the charge control agent dispersed in the surface portion of the obtained toner particles was measured by the following method. 100 mg of each toner was placed in a container with a diameter of 30 mm. With the addition of 20 particles of zirconia beads to the toner particles, 3.75 ml of water was added, and thereafter 15 ml of methanol was added to the mixture of toner particles and zirconia beads. The container was set to a ball mill and revolved for 4 minutes at 400 rpm. The magnetic toner particles were collected by causing a magnet to attract the magnetic toner particles over a period of approximately 8 minutes to separate the magnetic toner particles from a mixture of water and methanol, that is, an aqueous alcohol solvent. The aqueous alcohol solvent was filtered off. The amount of the charge control agent contained in the resultant extract liquid was calculated from the absorbance which was obtained by the absorptiometric method in accordance with the Lambert-Beer's law.

[Image formation test]

An image formation test was performed in such a manner that each of the magnetic toners prepared in Examples 1 to 5 and Comparative Examples 1 to 4 was set in a printer as shown in a single figure, comprising an electrophotographic photoconductor drum 1 and a developing means comprising a development sleeve 2 (a developer holding member) and a container 3 for storing the toner.

Using an image-bearing-material having an image area ratio of 1%, image formation was carried out under two different kinds of circumstances. Namely, 15,000 copies were made at 23° C. and 60% RH, and 10,000 copies were made at 30° C. and 90% RH. In both cases, the image densities (ID) of the copied image were measured at the initial stage and after making of 15,000 or 10,000 copies, and the occurrence of toner filming problem was visually inspected, and evaluated on the following scale:

◎: excellent (no toner filming)

○: good (slight toner filming, but acceptable for practical use.)

Δ: slightly poor (noticeable toner filming)

X: very poor (significant toner filming, not acceptable for practical use.)

The results are shown in TABLE 1.

TABLE 1

| | Magnetic Toner | | | | 23° C./60% RH | | | | 30° C./90% RH | | | |
|---|---|---|---|---|---|---|---|---|---|---|---|---|
| | Weight-average particle diameter of toner particles (μm) | C (g/g) | Sw ($cm^2/cm^3$) | C/Sw | At initial stage | | After making of 15,000 copies | | At initial stage | | After making of 10,000 copies | |
| | | | | | ID | Toner filming | ID | Toner filming | ID | Toner filming | ID | Toner filming |
| Ex. 1 | 9.0 | $1.5 \times 10^{-3}$ | 7000 | $2.14 \times 10^{-7}$ | 1.46 | ◎ | 1.4 | ○ | 1.42 | ◎ | 1.4 | ◎ |
| Ex. 2 | 9.0 | $2.9 \times 10^{-3}$ | 7000 | $4.17 \times 10^{-7}$ | 1.47 | ◎ | 1.47 | ◎ | 1.43 | ◎ | 1.44 | ◎ |
| Ex. 3 | 7.0 | $3.8 \times 10^{-3}$ | 9000 | $4.17 \times 10^{-7}$ | 1.47 | ◎ | 1.45 | ◎ | 1.42 | ◎ | 1.43 | ◎ |
| Ex. 4 | 6.0 | $7.7 \times 10^{-3}$ | 10500 | $7.33 \times 10^{-7}$ | 1.48 | ◎ | 1.41 | ○ | 1.43 | ◎ | 1.39 | ○ |
| Ex. 5 | 9.0 | $6.2 \times 10^{-3}$ | 7000 | $8.86 \times 10^{-7}$ | 1.46 | ◎ | 1.43 | ◎ | 1.45 | ◎ | 1.41 | ◎ |
| Comp. Ex. 1 | 6.0 | $1.5 \times 10^{-3}$ | 10000 | $1.5 \times 10^{-7}$ | 1.4 | ◎ | 1.35 | ◎ | 1.31 | ◎ | 1.1 | ◎ |
| Comp. Ex. 2 | 9.0 | $7.5 \times 10^{-3}$ | 7000 | $10.7 \times 10^{-7}$ | 1.5 | ◎ | 0.8 | x | 1.39 | ○ | 1.3 | Δ |
| Comp. Ex. 3 | 9.0 | $8.2 \times 10^{-3}$ | 9000 | $9.11 \times 10^{-7}$ | 1.47 | ◎ | 0.7 | x | 1.4 | ○ | 1 | x |
| Comp. Ex. 4 | 9.0 | $8.3 \times 10^{-3}$ | 7000 | $11.8 \times 10^{-7}$ | 1.5 | ◎ | 0.5 | x | 1.32 | ○ | 1.07 | x |

As can be seen from the results shown in TABLE 1, the toner filming on the development sleeve 2 was effectively prevented when the magnetic toner according to the present invention was employed.

By employing the above-mentioned magnetic toner according to the present invention, the image forming apparatus is capable of producing stable toner images for an extended long period of time.

Furthermore, the amount of the charge control agent present in the surface portion of the toner particles can be precisely measured by the method of the present invention.

Japanese Patent Application No. 11-157878 filed Jun. 4, 1999 is hereby incorporated by reference.

What is claimed is:

1. A magnetic toner with a negative polarity for developing latent electrostatic images, comprising toner particles, each toner particle comprising a binder resin, a magnetic powder, and a charge control agent, the surface of said magnetic toner satisfying the relationship of:

$$2\times10^{-7} \leqq C/Sw \leqq 10\times10^{-7}, \text{ provided } C \leqq 8\times10^{-3},$$

wherein C is an amount (g/g) of said charge control agent dissolved in a solvent comprising water and methanol per unit amount (g) of said toner particles, and Sw is a specific surface area ($cm^2/cm^3$) of said toner particles determined from a weight-average particle diameter of said toner particles.

2. The magnetic toner as claimed in claim 1, wherein said charge control agent comprises at least one metal-containing azo compound selected from the group consisting of compounds of formulas (I) to (III):

(I)

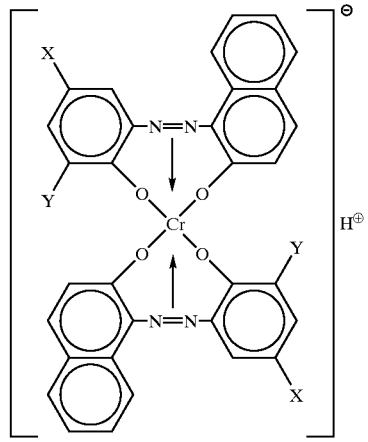

wherein X is nitro group, sulfonamide group, or a halogen atom; and Y is a hydrogen atom, a halogen atom, or nitro group, provided that X and Y are not nitro group at the same time;

(II)

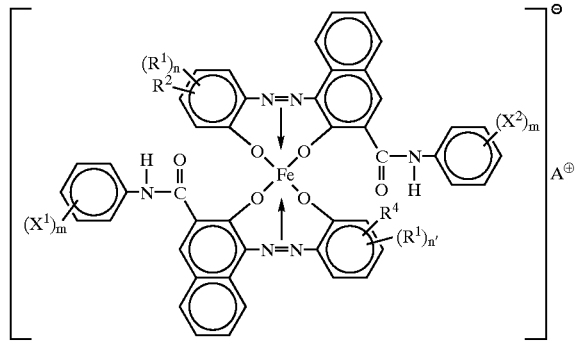

wherein $X^1$ and $X^2$, which may be the same or different, each are a hydrogen atom, a lower alkyl group, a lower alkoxyl group, nitro group, or a halogen atom; m and m' each are an integer of 1 to 3; $R^1$ and $R^3$, which may be the same or different, each are a hydrogen atom, an alkyl group having 1 to 19 carbon atoms, an alkenyl group, sulfonamide group, mesyl group, sulfonic group, carboxylate group, hydroxyl group, an alkoxyl group having 1 to 19 carbon atoms, acetylamino group, benzoylamino group, or a halogen atom; n and n' each are an integer of 1 to 3; $R^2$ and $R^4$ each are a hydrogen atom or nitro group; and $A^+$ is a hydrogen cation, sodium cation, potassium cation, or ammonium cation; and (III)

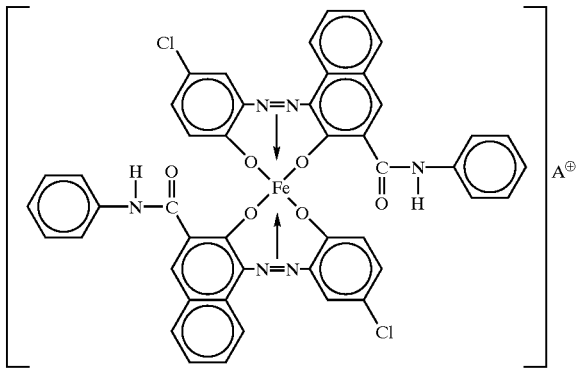

wherein $A^+$ is a mixture of $NH^+$, $Na^+$ and $H^+$, with a molar ratio of $NH^+$ to $Na^+$ to $H^-$ being (0.80 to 0.98):(0.01 to 0.19):(0.01 to 0.19) provided that the molar ratios of $NH^+$, $Na^-$ and $H^+$ is 1 in total.

3. An image forming apparatus comprising:

a member for bearing an electrostatic image thereon, and developing means for developing said electrostatic image with a developer, comprising a developer holding member provided with a magnet, and a developer container for storing said developer therein, said developer being a magnetic toner with a negative polarity comprising toner particles, each toner particle comprising a binder resin, a magnetic powder, and a charge control agent, the surface of said magnetic toner satisfying the relationship of:

$2\times10^{-7} \leqq C/Sw \leqq 10\times10^{-7}$, provided $C \leqq 8\times10^{-3}$, wherein C is an amount (g/g) of said charge control agent dissolved in a solvent comprising water and methanol per unit amount (g) of said toner particles, and Sw is a specific surface area ($cm^2/cm^3$) of said toner particles determined from a weight-average particle diameter of said toner particles.

4. The image forming apparatus as claimed in claim 3, wherein said charge control agent comprises at least one metal-containing azo compound selected from the group consisting of compounds of formulas (I) to (III):

(I)

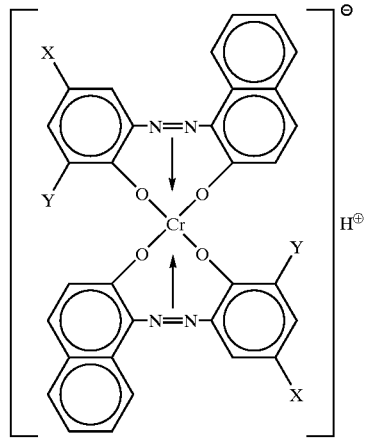

wherein X is nitro group, sulfonamide group, or a halogen atom; and Y is a hydrogen atom, a halogen atom, or nitro group, provided that X and Y are not nitro group at the same time;

(II)

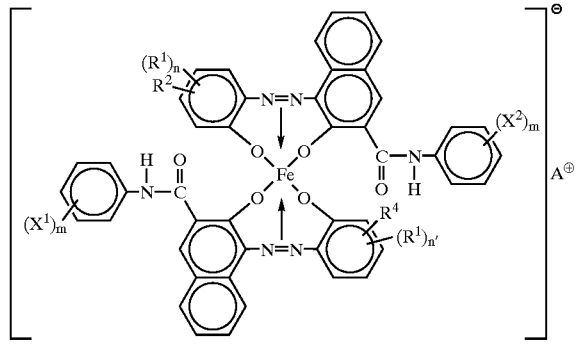

wherein $X^1$ and $X^2$, which may be the same or different, each are a hydrogen atom, a lower alkyl group, a lower alkoxyl group, nitro group, or a halogen atom; m and m' each are an integer of 1 to 3; $R^1$ and $R^3$, which may be the same or different, each are a hydrogen atom, an alkyl group having 1 to 19 carbon atoms, an alkenyl group, sulfonamide group, mesyl group, sulfonic group, carboxylate group, hydroxyl group, an alkoxyl group having 1 to 19 carbon atoms, acetylamino group, benzoylamino group, or a halogen atom; n and n' each are an integer of 1 to 3; $R^2$ and $R^4$ each are a hydrogen atom or nitro group; and $A^+$ is a hydrogen cation, sodium cation, potassium cation, or ammonium cation; and (III)
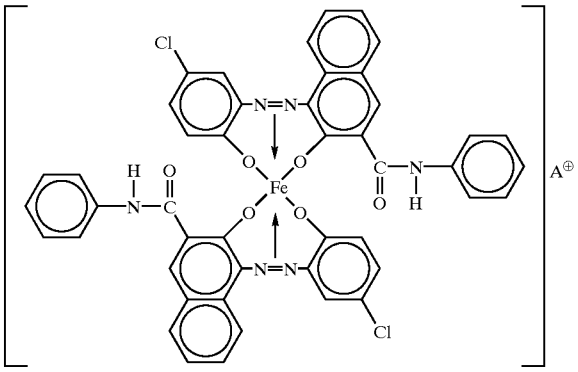
wherein $A^+$ is a mixture of $NH^+$, $Na^+$ and $H^-$, with a molar ratio of $NH^+$ to $Na^+$ to $H^+$ being (0.80 to 0.98):(0.01 to 0.19):(0.01 to 0.19) provided that the molar ratios of $NH^-$, $Na^+$ and $H^+$ is 1 in total.
* * * * *